US011420305B2

(12) United States Patent
Huber

(10) Patent No.: US 11,420,305 B2
(45) Date of Patent: Aug. 23, 2022

(54) METHOD FOR ELECTROSTATICALLY SCATTERING AN ABRASIVE GRAIN

(71) Applicant: Robert Bosch GmbH, Stuttgart (DE)

(72) Inventor: Johannes Huber, Constance (DE)

(73) Assignee: Robert Bosch GmbH, Stuttgart (DE)

( * ) Notice: Subject to any disclaimer, the term of this patent is extended or adjusted under 35 U.S.C. 154(b) by 25 days.

(21) Appl. No.: 16/488,842

(22) PCT Filed: Mar. 16, 2018

(86) PCT No.: PCT/EP2018/056612

§ 371 (c)(1),
(2) Date: Aug. 26, 2019

(87) PCT Pub. No.: WO2018/172193

PCT Pub. Date: Sep. 27, 2018

(65) Prior Publication Data

US 2019/0366511 A1 Dec. 5, 2019

(30) Foreign Application Priority Data

Mar. 20, 2017 (DE) ..... 10 2017 204 605.8

(51) Int. Cl.

| | |
|---|---|
| ***B24D 3/08*** | (2006.01) |
| ***B24D 3/34*** | (2006.01) |
| ***H01B 1/12*** | (2006.01) |

(52) U.S. Cl.

CPC ..... *B24D 3/344* (2013.01); *B24D 3/08* (2013.01); *B24D 3/34* (2013.01); *H01B 1/122* (2013.01); *H01B 1/127* (2013.01)

(58) Field of Classification Search

CPC .. B24D 18/0009; B24D 18/00; B24D 99/005; B24D 3/06; B24D 3/10; B24D 18/0027; B24D 3/28; B24D 11/001; B24D 11/00; B24D 11/005; B24D 3/34; B24D 18/0054; B24D 11/02; B24D 18/0018; B24D 18/0072; B24D 3/004; B24D 3/005;

(Continued)

(56) References Cited

U.S. PATENT DOCUMENTS 2,125,782 A * 8/1938 Heald ..... B24D 18/00 51/295
3,578,425 A * 5/1971 Wright et al. ..... B05D 1/60 51/295

(Continued)

FOREIGN PATENT DOCUMENTS

DE 690 09 903 T2 1/1995
EP 0304616 A1 * 3/1989 ..... C09K 3/14

(Continued)

OTHER PUBLICATIONS

JP-2009066986-A, machine translation (Year: 2009).*

(Continued)

*Primary Examiner* — Kevin E Yoon
*Assistant Examiner* — Marites A Guino-O Uzzle
(74) *Attorney, Agent, or Firm* — Maginot, Moore & Beck LLP

(57) ABSTRACT

A method for electrostatically scattering an abrasive grain includes applying at least one electro-conductive material to the abrasive grain. The electro-conductive material is in the form of at least one organic compound.

16 Claims, 4 Drawing Sheets

(58) Field of Classification Search
CPC . B24D 5/12; B24D 11/04; B24D 3/00; B24D 3/002; B24D 3/02; B24D 7/02; B24D 18/009; B24D 3/001; B24D 3/008; B24D 3/14; B24D 3/342; B24D 3/348; B24D 5/02; B24D 99/00; B24D 11/08; B24D 13/02; B24D 13/12; B24D 13/16; B24D 18/0036; B24D 18/0063; B24D 2203/00; B24D 3/007; B24D 3/285; B24D 3/32; B24D 3/344; B24D 3/346; B24D 5/04; B24D 7/04; B24D 3/08; H01B 1/122; H01B 1/124; H01B 1/127; H01B 5/00; H01B 1/12; C09J 2301/314; C09J 2201/602; C09K 2323/04; C08J 7/04; C08J 7/044; C08K 2201/00; C08K 2201/001; C23C 26/00; C23C 28/00
See application file for complete search history.

(56) References Cited

U.S. PATENT DOCUMENTS 3,984,214 A 10/1976 Pratt et al.
5,009,674 A * 4/1991 Kunz ..... C09K 3/14 51/295
5,061,294 A * 10/1991 Harmer ..... B24D 3/004 51/295
5,201,916 A * 4/1993 Berg ..... B24D 3/14 264/6
6,638,601 B1 10/2003 Follensbee
9,321,947 B2 * 4/2016 Manning ..... B24D 3/00
2011/0219703 A1 * 9/2011 Fuchs ..... C09K 3/1409 51/308
2013/0312337 A1 * 11/2013 Moren ..... B05D 5/02 51/309
2015/0336801 A1 11/2015 Chakraborty et al.
2016/0177109 A1 * 6/2016 Hendricks ..... D06M 15/3566 428/36.91

FOREIGN PATENT DOCUMENTS

JP 2009066986 A * 4/2009
JP 2009-170319 A 7/2009

OTHER PUBLICATIONS

Palacio, M., Bhushan, B. A Review of Ionic Liquids for Green Molecular Lubrication in Nanotechnology. Tribol Lett 40, 247-268 (2010). doi:10.1007/s11249-010-9671-8 (Year: 2010).*
Selimar Rivera-Rubero and Steven Baldelli, Influence of Water on the Surface of Hydrophilic and Hydrophobic Room-Temperature Ionic Liquids, Journal of the American Chemical Society 2004 126 (38), 11788-11789 DOI: 10.1021/ja0464894 (Year: 2004).*
Shi, R., Wang, Y. Dual Ionic and Organic Nature of Ionic Liquids. Sci Rep 6, 19644 (2016). DOI:10.1038/srep19644 (Year: 2016).*
Ya-Hung Yu, Allan N. Soriano, Meng-Hui Li, Heat capacity and electrical conductivity of aqueous mixtures of [Bmim][BF4] and [Bmim][PF6], Journal of the Taiwan Institute of Chemical Engineers, vol. 40, Iss 2, 2009, pp. 205-212. DOI:10.1016/j.jtice.2008.09.006. (Year: 2009).*
Britannica, The Editors of Encyclopaedia. "Corundum". Encyclopedia Britannica, Jan. 9, 2019, <URL: https://www.britannica.com/science/corundum>. Accessed Sep. 9, 2021. (Year: 2019).*
Organic Compounds. (Jun. 10, 2020). Retrieved Sep. 10, 2021, from <URL: https://chem.libretexts.org/@go/page/219141> (Year: 2020).*
International Search Report corresponding to PCT Application No. PCT/EP2018/056612, dated Jun. 18, 2018 (German and English language document) (5 pages).

* cited by examiner

METHOD FOR ELECTROSTATICALLY SCATTERING AN ABRASIVE GRAIN

This application is a 35 U.S.C. § 371 National Stage Application of PCT/EP2018/056612, filed on Mar. 16, 2018, which claims the benefit of priority to Serial No. DE 10 2017 204 605.8, filed on Mar. 20, 2017 in Germany, the disclosures of which are incorporated herein by reference in their entirety.

BACKGROUND

A method for electrostatically scattering an abrasive grain has already been proposed, wherein in at least one process step at least one electrically conductive material is applied to the abrasive material. Conventional inorganic salts with a hygroscopic character are applied. As a result, the electrical conductivity on the surface of the abrasive grain can be moisture-dependent and decreasing with decreasing humidity. The grainfall behavior is therefore also dependent on the humidity and on the amount and type of salt used. Non-electrically conductive abrasive grains such as diamond or very coarse abrasive grain are not currently electrostatically scatterable.

SUMMARY

The disclosure is based on a method for the electrostatic scattering of an abrasive grain, wherein in at least one process step at least one electrically conductive material is applied to the abrasive material.

It is proposed that the electrically conductive material is in the form of at least one organic compound.

Advantageously, an improved electrostatic scattering ability can be achieved by means of an electrically conductive coating with an organic compound. In particular, electrostatic scatterability of non-conductive and/or poorly conductive abrasive grain materials can advantageously be made possible, whereby alignment of the abrasive grains can be advantageously optimized. In particular, as a result abrasive grains of different materials can be advantageously scattered in one working step. In addition, advantageously, in particular in contrast to the prior art, scattering behavior that is independent of the humidity can be enabled, whereby grainfall behavior can be advantageously improved.

"Electrostatic scattering" means in particular, a scattering process in which electrically polarizable abrasive grains are applied to a base by an in particular static electric field, preferably against gravity, for example to a grinding wheel, a grinding paper, a grinding tool and/or a grinding belt. In this way, advantageously, targeted distribution, in particular a targeted spreading density, of the abrasive grains on the base can be achieved.

An "abrasive grain" means in particular a body that preferably comprises at least one abrasive edge. In particular, the abrasive grain is intended to process, in particular to grind, a workpiece, in particular by means of the abrasive edge. In particular, the abrasive grain is formed from an in particular hard material with a Mohs hardness of at least 7, preferably at least 8, preferentially at least 9 or particularly preferably at least 10. Preferably, the abrasive grain is at least partially made of a ceramic and/or a crystal such as, for example, corundum, zirconium oxide, silicon carbide, boron nitride, diamond, tungsten carbide, ceroxide and/or another material known to the person skilled in the art. In particular, the abrasive grain may have a defined geometry. "Abrasive grains with a defined geometry" means in particular abrasive grains with at least substantially an identical and at least substantially predetermined form, for example a rod, sphere, box, tetrahedron, or any other polyhedron. An "at least substantially identical form" means in particular that the abrasive grains have an identical shape except for production process-related deviations and preferably have an identical size.

An "electrically conductive material" means in particular a material that allows electrical charge transport. In particular, the electrical charge transport can be carried out by means of electrons and/or by means of ions.

An "organic compound" means in particular a chemical substance and/or a combination of a plurality of chemical substances that is based on the element carbon and in addition to carbon comprises at least hydrogen, oxygen and/or nitrogen. In particular, an organic compound comprises at least one organic salt, preferably an organic salt that is liquid in particular at a temperature of less than 100° C., preferably below 50° C. or preferentially below 25° C. In particular, the organic compound may be in the form of at least one ionic liquid and/or a conductive polymer. It is conceivable that the organic compound is either applied in pure form to the abrasive grain and/or as a solution, for example dissolved in water, on the abrasive grain.

It is also proposed that, in at least one process step, an organic compound in the form of at least one ionic liquid is applied to the abrasive grain. In particular, ionic solutions have a very low vapor pressure. Thus, a very thin, in particular slowly evaporating, layer can advantageously be applied to an abrasive grain. This advantageously ensures a good, in particular uniform distribution of the organic compound on the surface of the abrasive grain. In particular, ionic liquids have good electrical conductivity, in particular ion conductivity, whereby advantageously good polarizability of the coated abrasive grain can be made possible, in particular during a scattering process. In addition, by means of a coating with an ionic liquid an electrical conductivity independent of the humidity can advantageously be achieved, in particular an ion conductivity. In particular, the organic compound, preferably the ionic liquid, may contain an imidazole ring and/or an imidazolium ion, in particular an imidazolium cation. In particular, the ionic liquid can contain liquid 1-Butyl-3-methylimidazolium tetrafluoroborate.

In addition, it is proposed that in at least one process step an organic compound in the form of at least an intrinsically conductive polymer is applied to the abrasive grain. Thus, the electrical conductivity of poorly conductive and/or non-conductive abrasive grains can be increased and/or made possible, whereby scatterability by an electric field can be advantageously made possible. In particular, the intrinsically conductive polymer is applied in the process step by means of dispersion and/or in a melt and/or as a solution. In particular, an "intrinsically conductive polymer" means a plastic having electrical conductivity that is in particular comparable with the electrical conductivity of a metal. The intrinsically conductive polymer may, for example, include poly (3,4-ethylenedioxythiophene) polystyrene sulfonate (PEDOT:PSS).

If a mass proportion of the organic compound applied to the abrasive grain in the process step is in particular less than 5%, preferably less than 1% or particularly preferably less than 0.1% of the total mass of the abrasive grain covered with the organic compound, an increase in the mass of the abrasive grain with a coating can be kept advantageously low. This can advantageously maintain good grainfall behavior. In addition, the consumption of and/or demand for coating material can be kept low, whereby costs, in particular material costs, can advantageously be kept low. A "mass proportion" means in particular the value of the quotient of the mass of a considered mixing component, for example the organic compound, and the total mass of the mixture, in particular the abrasive grain with a coating of the organic compound.

Furthermore, it is proposed that a maximum layer thickness of the organic compound, which is applied to the abrasive grain in the process step, is in particular less than 30 microns, is preferably less than 1 micron or particularly preferably is less than 100 nm. As a result, an increase in the mass of the abrasive grain with a coating can advantageously be kept low. Good grainfall behavior can also advantageously be achieved and/or maintained as a result.

In addition, the consumption and/or demand for coating material can be kept low. Moreover, a surface change of the uncoated abrasive grain can be kept small with a small layer thickness, whereby an effect on the grainfall behavior, in particular by the coating, can be kept small. In addition, a small layer thickness advantageously allows facilitated and/or rapid diffusing of the coating after the spreading process, in particular in a binding agent.

Furthermore, an abrasive grain that is electrostatically scatterable is proposed, which has at least one coating formed from at least one electrically conductive organic compound, whereby electrostatic scatterability of a poorly conductive and/or non-conductive abrasive grain can advantageously be made possible.

If the coating is in the form of at least one ionic liquid and/or at least one, in particular intrinsically conductive polymer, a very thin, in particular slowly evaporating, layer can be applied to an abrasive grain. This advantageously ensures good, in particular uniform distribution of the organic compound on the surface of the abrasive grain. In particular, ionic liquids and conductive polymers have good electrical conductivity, whereby good polarizability of the coated abrasive grain can advantageously be made possible, in particular during a scattering process. In addition, electrical conductivity independent of the humidity, in particular ion conductivity, can be advantageously achieved by means of a coating with an ionic liquid. In addition, the electrical conductivity of poorly conductive and/or nonconductive abrasive grains can be increased and/or enabled, whereby scatterability by an electric field can advantageously be made possible.

In addition, an abrasive material is proposed that includes diamond, ceramics, corundum, silicon carbide, tungsten carbide, zirconium oxide and/or ceroxide. As a result, it can be advantageously enabled that with known methods non-scatterable and/or poorly scatterable materials, in particular ceramic and/or diamond, are made electrostatically scatterable, whereby new grinding tools, which combine the advantageous properties of the respective abrasive materials and the advantageous properties of electrostatically scattered and/or aligned abrasive grains, can advantageously be made manufacturable.

In addition, an abrasive grain size, in particular an abrasive grain diameter is proposed, in particular of more than 10 microns, preferably of more than 100 microns or more preferably of more than 1000 microns. Such an abrasive grain diameter corresponds to a coarse abrasive grain, whereby grinding tools with coarse abrasive grains can advantageously be prepared, which are in particular advantageously scatterable by electrostatic scattering and can be aligned. An "abrasive grain size" means in particular a length extent of the abrasive grain parallel to a main extension plane of the abrasive grain. A "main extension plane" of a unit means in particular a plane that is parallel to a major lateral surface of a very small virtual box that just completely encloses the unit, and in particular that passes through the center of the box.

If the coating is at least partly hydrophobic, in particular in the case of non-aqueous binding agents and/or non-aqueous binding agent solutions, electrostatic scattering can advantageously be enabled at any humidity without influencing and/or impairing the scattering ability and/or the grainfall behavior.

Furthermore, an abrasive means with at least one abrasive grain is proposed, for example a grinding wheel, a sanding paper, a sanding belt and/or another abrasive means on a base and known to the person skilled in the art.

The method according to the disclosure for the electrostatic scattering of an abrasive grain, in particular the abrasive grain and the grinding tool should not be limited to the application and embodiment described above. In particular, the method according to the disclosure for the electrostatic scattering of an abrasive grain, in particular the abrasive grain and the grinding tool for the fulfillment of a manner of operation described herein may comprise a different number of individual elements, components and units from a number of individual elements, components and units mentioned herein.

BRIEF DESCRIPTION OF THE DRAWINGS

Further advantages result from the following description of the drawing. An exemplary embodiment of the disclosure is shown in the drawing. The drawing, description and claims contain numerous features in combination. The person skilled in the art will consider the features appropriately and individually and will combine them into meaningful further combinations.

In the figures.

DETAILED DESCRIPTION

Figure 1:
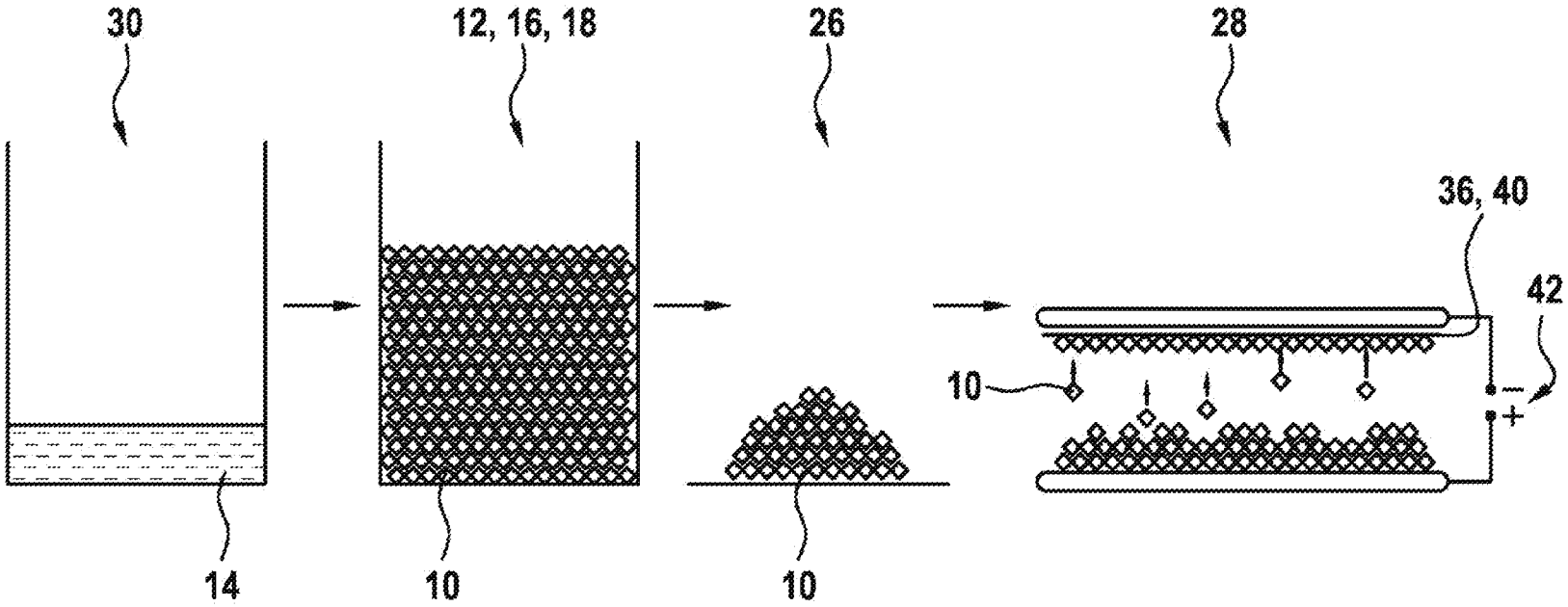
FIG. 1 shows an overview sketch of the method according to the disclosure for the electrostatic scattering of an abrasive grain.

FIG. 1 shows a schematic process of the method for the electrostatic scattering of an abrasive grain 10. In at least one process step 30, an electrically conductive material 14 is provided. The electrically conductive material 14 is in the form of an organic compound. The electrically conductive material 14 may in particular at least partly contain other liquids and/or may be diluted with water.

In at least one process step 12, 16, 18, the electrically conductive material 14 is applied to the abrasive grain 10.

In at least one process step 16, the electrically conductive material 14 is in the form of an ionic liquid. In at least one process step 16, the ionic liquid in the form of an organic compound is applied to the abrasive grain 10.

In at least one process step 18, the electrically conductive material 14 is in the form of an intrinsically conductive polymer. In at least one process step 18, the intrinsically conductive polymer in the form of an organic compound is applied to the abrasive grain 10.

A mass proportion of the organic compound applied to the abrasive grain 10 in at least one process step 12, 16, 18 is less than 5% of the total mass of the abrasive grain 10 covered by the organic compound. The mass proportion of the electrically conductive material 14 applied to the abrasive grain 10 in at least one process step 12, 16, 18 is less than 5% of the total mass of the abrasive grain 10 covered by the electrically conductive material 14. The mass proportion of the ionic liquid applied to the abrasive grain 10 in at least one process step 16 is less than 5% of the total mass of the abrasive grain 10 covered by the ionic liquid. The mass proportion of the intrinsically conductive polymer that is applied to the abrasive grain 10 in at least one process step 18 is less than 5% of the total mass of the abrasive grain 10 covered by the intrinsically conductive polymer.

A maximum layer thickness 20 (cf. FIG. 3) of the electrically conductive material 14 that is applied to the abrasive grain 10 in at least one process step 12, 16, 18 is less than 30 microns.

In at least one process step 26, the coated abrasive grain 10 is dried. During drying, water and/or solvents from the electrically conductive material 14 and/or a coating 22 of the abrasive grain 10 evaporate (see FIG. 3).

In at least one process step 28, coated abrasive grain 10 is electrostatically scattered. In electrostatic scattering, the abrasive grain 10 is accelerated in an electric field 42. The abrasive grain 10 moves in the electric field 42 towards a base 36. The base 36 comprises a binding agent 40. The binding agent 40 is provided to produce an adhesive force between the base 36 and the abrasive grain 10. Under the influence of the binding agent 40, the abrasive grain 10 adheres to the base 36. The electric field 42 also serves to align the abrasive grain 10 on the base 36, in particular before generating the adhesive force. In addition, a further alignment can take place in the electric field 42, in particular along electric field lines after and/or during an adhesive process and/or during the build-up of the adhesive force, in particular after the abrasive grain 10 has arrived on the base 36. Thus, uniform alignment of the abrasive grains 10 can be advantageously achieved, wherein for example, the abrasive grain 10 can have at least one pointed edge 44, which points away from the base 36, in particular due to the alignment in the electric field 42.

Figure 2:
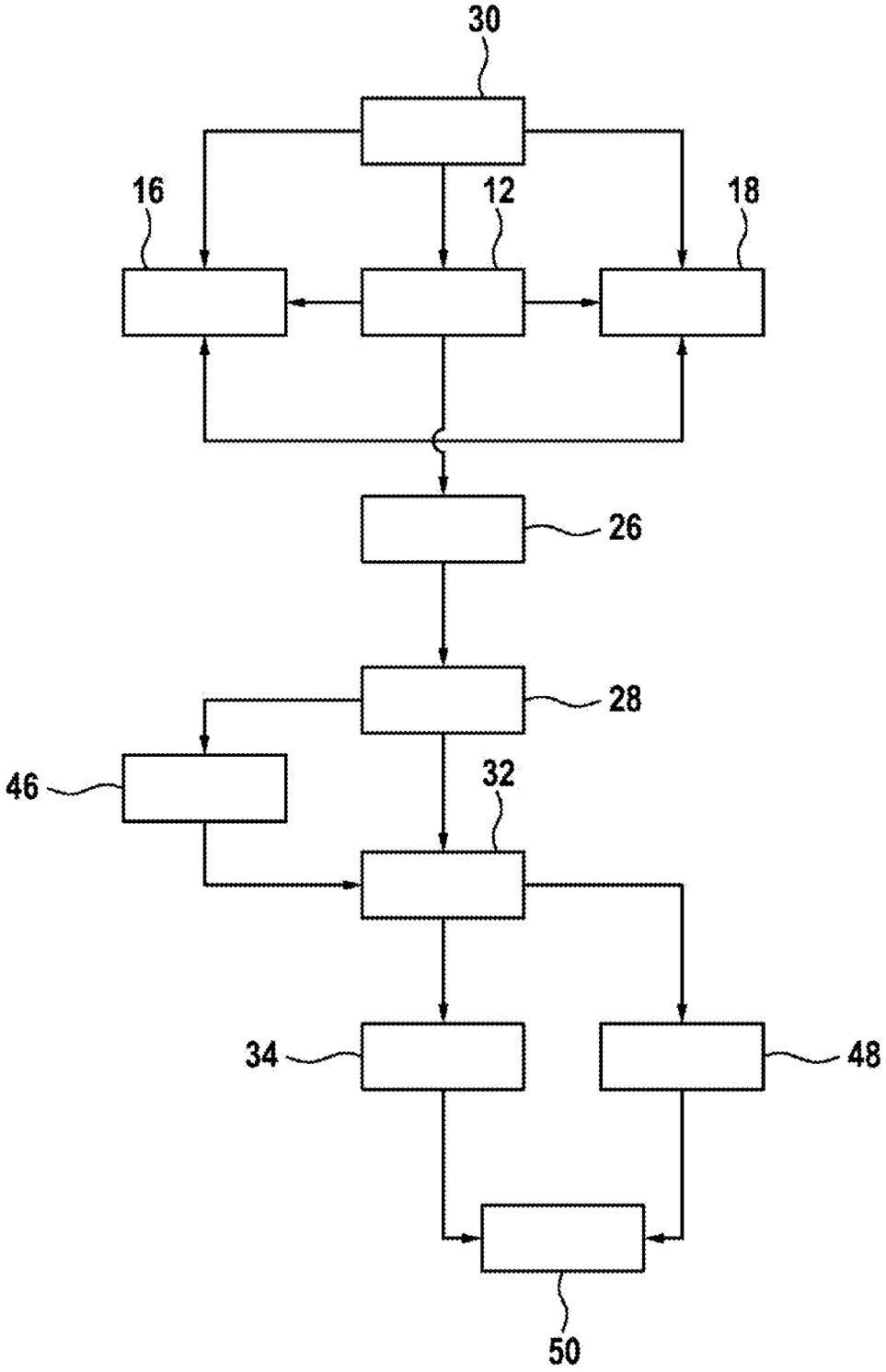
FIG. 2 shows a flowchart of the method.

FIG. 2 shows a schematic flow diagram of the method for electrostatic scattering of the abrasive grain 10. In at least one process step 46, the abrasive grain 10 is aligned relative to the base 36 by means of the electric field 42. In particular, it is conceivable that a person skilled in the art may also make use of an alternative sequence of process steps 12, 16, 18, 26, 28, 30, 32, 34, 46, 48, 50 that seems sensible to him.

In at least one process step 32, a frictional connection between the base 36 and the abrasive grain 10 is made by means of the binding agent 40.

In at least one process step 34 the electrically conductive material 14 diffuses in particular to a large extent, preferably completely. Preferably, the electrically conductive material 14 diffuses into the binding agent 40. This can advantageously produce a hard surface for grinding, in particular formed by the abrasive grain 10.

Alternatively, in at least one process step 48 the electrically conductive material 14 is flushed out. Preferably, the electrically conductive material 14 is in a water-soluble form.

In at least one process step 50, an abrasive means 24, for example a grinding wheel 52 (cf. FIG. 5), is made from the base 36 to which a plurality of abrasive grains 10 adhere.

Figure 3:
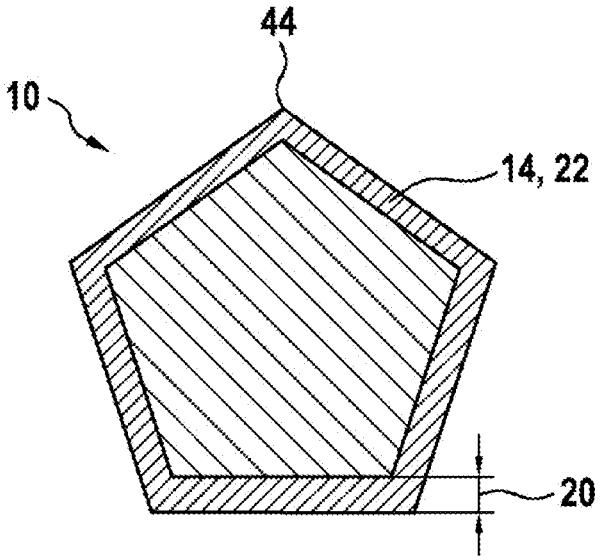
FIG. 3 shows a coated abrasive grain in a sectional view, FIGS. 4 (*a*) and (*b*) show an enlarged view of an abrasive means produced by means of the method.

FIG. 3 shows a section through an abrasive grain 10. The abrasive grain 10 has the coating 22. The coating 22 comprises an electrically conductive material 14 and/or an electrically conductive organic compound and/or an ionic liquid and/or an intrinsically conductive polymer. The coating 22 has a layer thickness 20. The layer thickness 20 is less than 30 microns. The abrasive grain 10 has a pointed edge 44. The coating 22 is of at least partially hydrophobic form.

The abrasive material of the abrasive grain 10 contains diamond, ceramic, corundum, silicon carbide, tungsten carbide, zirconium oxide and/or ceroxide.

The abrasive grain 10 has an abrasive grain size, in particular an abrasive grain diameter, of more than 10 microns.

Figure 4A:
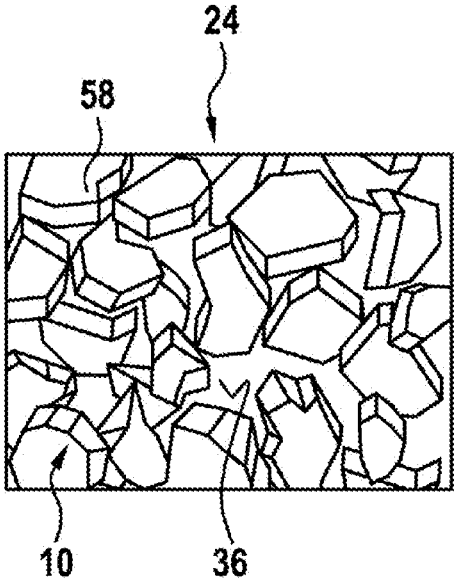
Figure 4B:
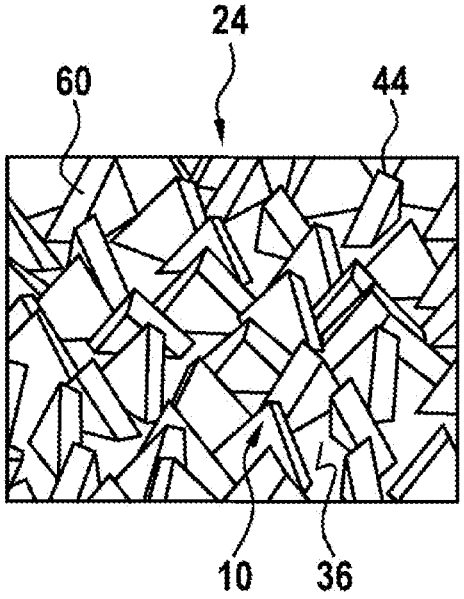

FIG. 4*a* and FIG. 4*b* each show an enlarged view of the abrasive means 24. The abrasive means 24 each comprise a base 36 and a plurality of abrasive grains 10. The abrasive grains 10 of the abrasive means 24 shown in FIG. 4*a* have an irregular form 58.

The abrasive grains 10 of the abrasive means 24 shown in FIG. 4*a* are arranged in an unaligned way. The abrasive grains 10 of the abrasive means 24 shown in FIG. 4*b* essentially have a three-sided prism shape 60.

The abrasive grains 10 of the abrasive means 24 shown in FIG. 4*b* are arranged in an aligned way. The pointed edge of the three-sided prism shape 60 is oriented in a direction essentially pointing away from the base 36.

Figure 5:
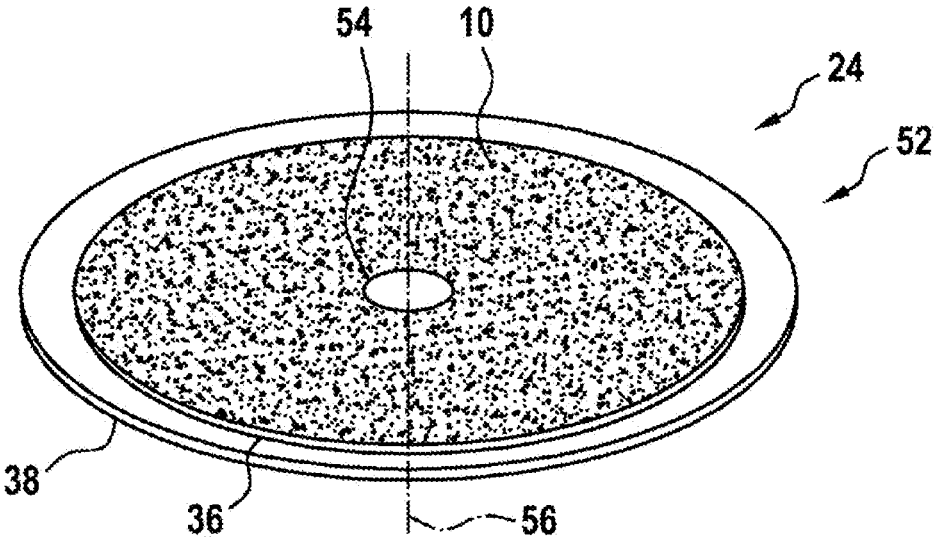
FIG. 5 shows the grinding means in the form of a grinding wheel.

FIG. 5 shows a full view of the abrasive means 24 with the plurality of abrasive grains 10. The abrasive means is in the form of a grinding wheel 52. The grinding wheel 52 has an at least substantially round, flat disc shape 38. A hub 54 is disposed in the center of the grinding wheel 52. The hub 54 is in the form of a hole in the grinding wheel 52. The hub 54 is used to attach the grinding wheel 52 to a tool. In a grinding operation, the grinding wheel 52 is provided to rotate about a rotary axis 56 that is disposed in particular in the center of the hub 54, perpendicular to the base 36.

The invention claimed is:

1. A method for applying a plurality of abrasive grains on a surface, comprising;

applying at least one ionic liquid to each of the plurality of abrasive grains to substantially coat the abrasive grain;

wherein the at least one ionic liquid is an organic compound; and then electrostatically applying the coated plurality of abrasive grains to the surface.

2. A method for applying a plurality of abrasive grains on a surface, comprising;

applying an intrinsically conductive polymer to each of the plurality of abrasive grains to substantially coat the abrasive grain;

wherein the intrinsically conductive polymer is an organic compound; and then electrostatically applying the coated plurality of abrasive grains to the surface.

3. The method as claimed in claim 1, wherein a mass proportion of the at least one organic compound applied to each of the plurality of abrasive grains is less than 5% of a total mass of the abrasive grain covered with the at least one organic compound.

4. The method as claimed in claim 1, wherein a maximum layer thickness of the at least one organic compound applied to each of the plurality of abrasive grains is less than thirty microns.

5. The method as claimed in claim 1, wherein the step of electrostatically applying includes accelerating each of said plurality of grains toward the surface in an electric field.

6. The method as claimed in claim 1, wherein the step of electrostatically applying includes aligning each of said plurality of grains on the surface in a predetermined orientation.

7. The method as claimed in claim 6, wherein each of said plurality of grains has at least one pointed edge, and said predetermined orientation is with one of said at least one pointed edge pointing away from surface.

8. The method as claimed in claim 1, wherein said organic compound includes at least one organic salt.

9. The method as claimed in claim 1, wherein said at least one ionic liquid includes 1-Butyl-3-methylimidazolium tetrafluoroborate.

10. The method as claimed in claim 2, wherein said intrinsically conductive polymer includes poly (3,4-ethylenedioxythiophene) polystyrene sulfonate (PEDOT:PS).

11. The method as claimed in claim 2, wherein a mass proportion of the at least one organic compound applied to each of the plurality of abrasive grains is less than 5% of a total mass of the abrasive grain covered with the at least one organic compound.

12. The method as claimed in claim 2, wherein a maximum layer thickness of the at least one organic compound applied to each of the plurality of abrasive grains is less than thirty microns.

13. The method as claimed in claim 12, wherein the step of electrostatically applying includes accelerating each of said plurality of grains toward the surface in an electric field.

14. The method as claimed in claim 2, wherein the step of electrostatically applying includes aligning each of said plurality of grains on the surface in a predetermined orientation.

15. The method as claimed in claim 2, wherein each of said plurality of grains has at least one pointed edge, and said predetermined orientation is with one of said at least one pointed edge pointing away from surface.

16. The method as claimed in claim 2, wherein said organic compound includes at least one organic salt.

* * * * *